US011851152B2

(12) United States Patent
Kitsu et al.

(10) Patent No.: US 11,851,152 B2
(45) Date of Patent: Dec. 26, 2023

(54) OUTBOARD MOTOR

(71) Applicant: HONDA MOTOR CO., LTD., Tokyo (JP)

(72) Inventors: Kunihiro Kitsu, Wako (JP); Taiichi Otobe, Wako (JP); Kazuyoshi Sato, Wako (JP); Yoshiyuki Matsuda, Wako (JP); Akifumi Fujima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 220 days.

(21) Appl. No.: 17/467,488

(22) Filed: Sep. 7, 2021

(65) Prior Publication Data

US 2022/0081094 A1 Mar. 17, 2022

(30) Foreign Application Priority Data

Sep. 14, 2020 (JP) ..... 2020-153601

(51) Int. Cl.

| | |
|---|---|
| ***B63H 21/21*** | (2006.01) |
| ***B63H 20/12*** | (2006.01) |
| ***B63H 20/00*** | (2006.01) |
| ***B63H 25/02*** | (2006.01) |

(52) U.S. Cl.

CPC ..... *B63H 21/213* (2013.01); *B63H 20/007* (2013.01); *B63H 20/12* (2013.01); *B63H 25/02* (2013.01); *B63H 2025/024* (2013.01)

(58) Field of Classification Search

CPC .... B63H 21/213; B63H 20/007; B63H 20/12; B63H 25/02; B63H 2025/024

See application file for complete search history.

(56) References Cited

U.S. PATENT DOCUMENTS 5,797,777 A * 8/1998 Tsunekawa ..... B63H 21/213 440/86
9,789,945 B1 10/2017 Vaninetti et al.
2013/0012080 A1 1/2013 Yoshikawa et al.

FOREIGN PATENT DOCUMENTS

JP 2013-014256 1/2013
JP 2018-090047 6/2018

OTHER PUBLICATIONS

Japanese Office Action for Japanese Patent Application No. 2020-153601 dated Aug. 1, 2021.

* cited by examiner

*Primary Examiner* — Stephen P Avila
(74) *Attorney, Agent, or Firm* — AMIN, TUROCY & WATSON, LLP

(57) ABSTRACT

An outboard motor includes a trolling mode. The outboard motor includes an outboard motor body including a propeller and a drive source, a tiller handle body extending forward from the outboard motor body, a grip handle extending from a front end surface of the tiller handle body and configured to steer the outboard motor body via the tiller handle body, and a trolling switch attached to the tiller handle body and configured to adjust a trolling speed. An operation portion of the trolling switch is attached to a lower front end surface of the tiller handle body, the lower front end surface being located below the grip handle.

7 Claims, 5 Drawing Sheets

14

OUTBOARD MOTOR

CROSS-REFERENCE TO RELATED APPLICATION

This application is based upon and claims the benefit of priority from Japanese Patent Application No. 2020-153601 filed on Sep. 14, 2020, the contents of which are incorporated herein by reference.

BACKGROUND OF THE INVENTION

Field of the Invention

The present invention relates to an outboard motor having a tiller handle for steering.

Description of the Related Art

Vessels may include outboard motors having tiller handles. In this case, the vessel operator can steer the outboard motor by gripping the grip of the tiller handle. In addition, the vessel operator can change the rotational speed of the propeller (ultimately, the vessel speed) by turning the grip.

The vessel may travel at a relatively low speed due to drift fishing, trolling (troll fishing), or the like. In such a case, it is preferable that the vessel speed can be finely adjusted according to the situation. That is, it is preferable that the vessel speed can be finely adjusted while steering using the tiller handle. However, fine adjustment of the vessel speed while steering the vessel over a long period of time imposes a heavy burden on the vessel operator. In addition, fine adjustment of the vessel speed requires skill and considerable training of the vessel operator.

JP 2013-014256 A discloses a tiller handle having a switch unit for adjusting the rotational speed of an engine of an outboard motor during trolling operation. However, it is not easy to simultaneously perform the steering and the fine adjustment of the trolling speed in parallel by using the tiller handle. That is, it is a task of the present invention to improve operability of trolling speed adjustment in an outboard motor.

SUMMARY OF THE INVENTION

An object of the present invention is to solve the above-described task.

According to an aspect of the present invention, there is provided an outboard motor having a trolling mode, the outboard motor including: an outboard motor body including a propeller and a drive source; a tiller handle body extending forward from the outboard motor body; a grip handle extending from a front end surface of the tiller handle body and configured to steer the outboard motor body via the tiller handle body; and a trolling switch attached to the tiller handle body and configured to adjust a trolling speed, wherein an operation portion of the trolling switch is attached to a lower front end surface of the tiller handle body, the lower front end surface being located below the grip handle.

According to the present invention, it is possible to provide an outboard motor in which the operability of trolling speed adjustment is improved.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
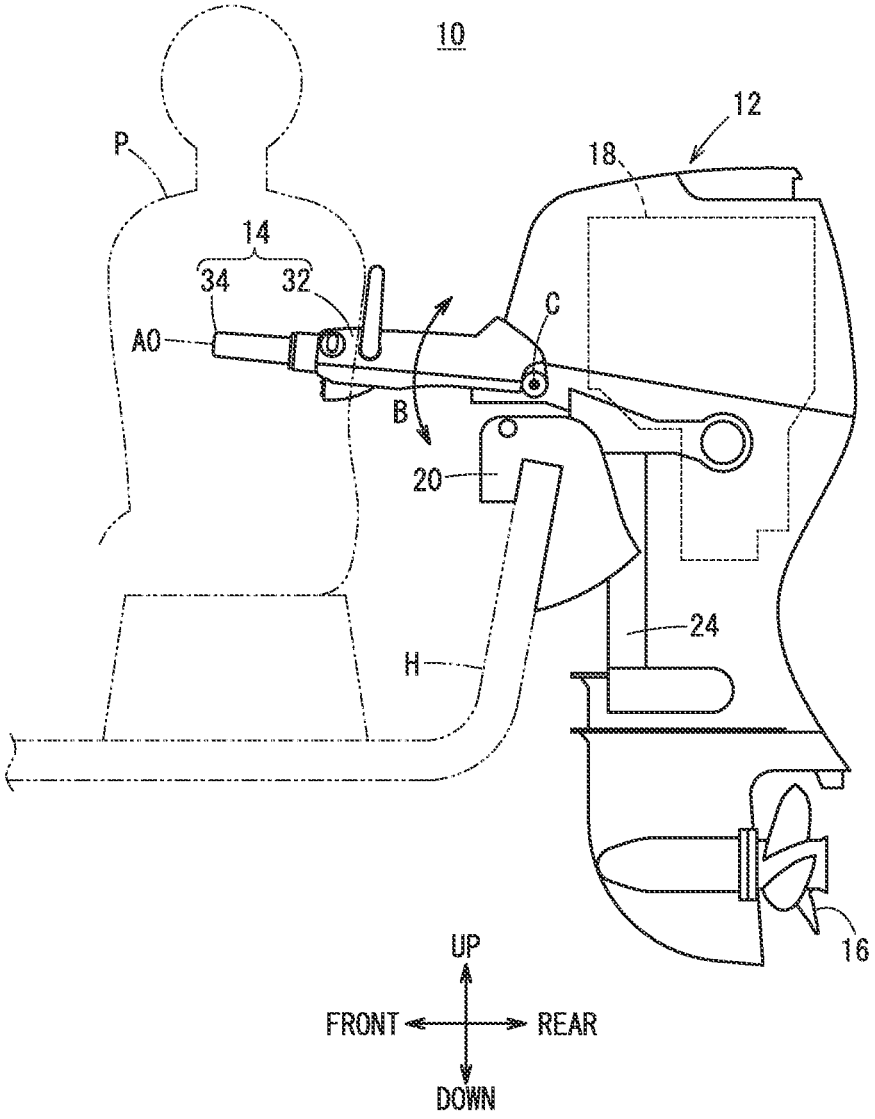
FIG. 1 is a side view illustrating an outboard motor according to an embodiment.

FIG. 1 is a side view illustrating an outboard motor 10 according to an embodiment. Here, the outboard motor 10 is attached to the hull (vessel's body) H. The outboard motor 10 includes an outboard motor body 12 and a tiller handle 14.

The outboard motor body 12 is steerably attached to the hull H and rotates a propeller 16. The tiller handle 14 extends forward (toward the hull H) from the outboard motor body 12. The tiller handle 14 is used by the vessel operator P to steer the outboard motor body 12.

The outboard motor body 12 includes the propeller 16 and an engine (drive source) 18 that rotates the propeller 16. The outboard motor body 12 is attached to the hull H via a mounting bracket 20. The outboard motor body 12 is connected to the mounting bracket 20 via a swivel case 24. The outboard motor body 12 is rotatable (steerable) in the left-right direction and tiltable in the up-down direction.

The tiller handle 14 is connected to a side portion (here, a left side portion) of the outboard motor body 12 so as to be rotatable in the vertical direction (about a shaft C extending in the horizontal direction), as shown by the arrow B. This causes the tiller handle 14 to pivot upwardly and downwardly from the position shown in solid lines in FIG. 1. The tiller handle 14 can be stopped and held at any angle.

Figure 2:
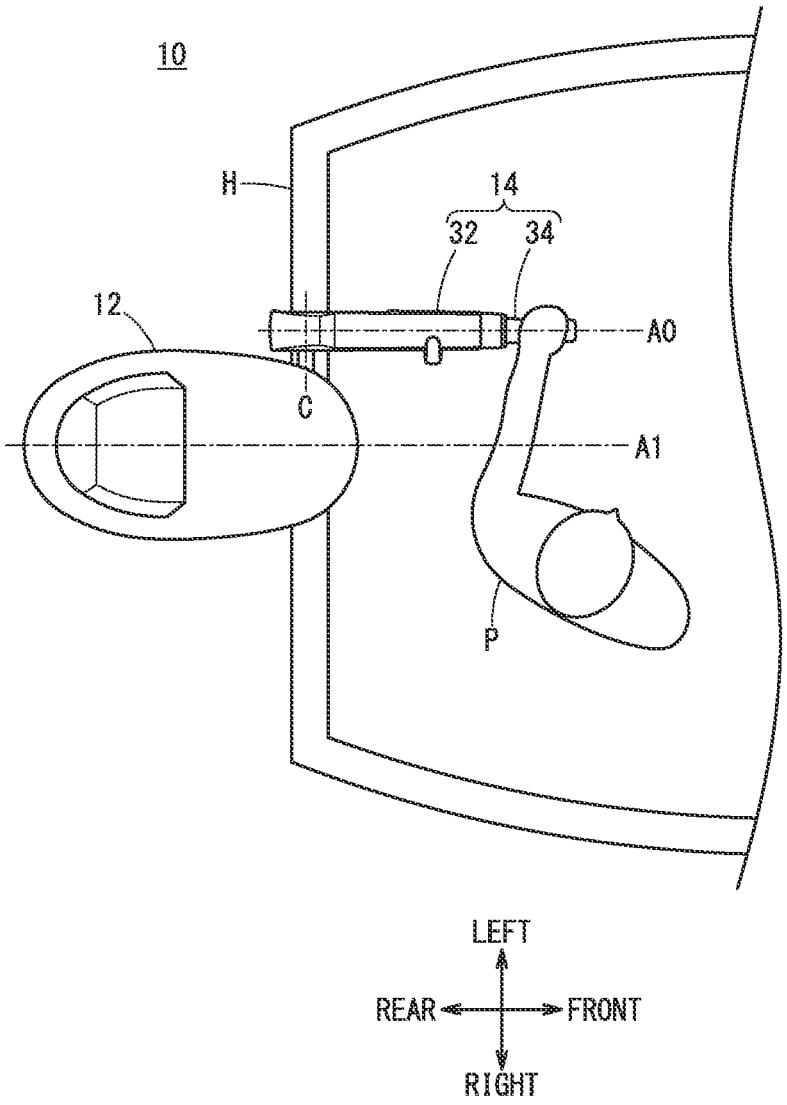
FIG. 2 is a top view illustrating the outboard motor according to the embodiment.

FIG. 2 is a top view illustrating the outboard motor 10 according to the embodiment. The vessel operator P sits or stands at a position on the opposite side (here, the right side) of the center line A1 of the outboard motor body 12 from the center line A0 of the tiller handle 14. The vessel operator P performs steering at this position.

Figure 3:
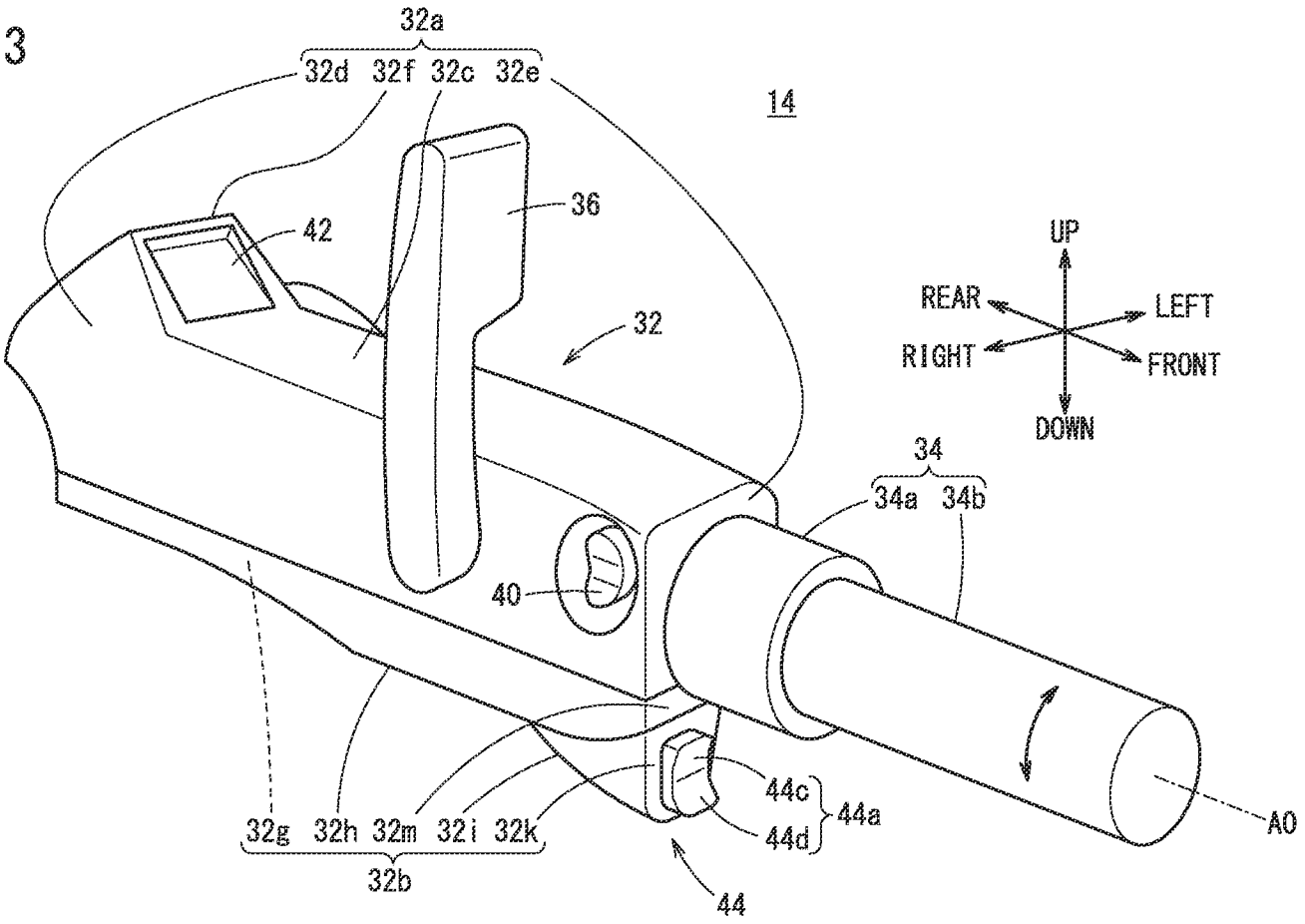
FIG. 3 is a perspective view showing a tiller handle.
Figure 4:
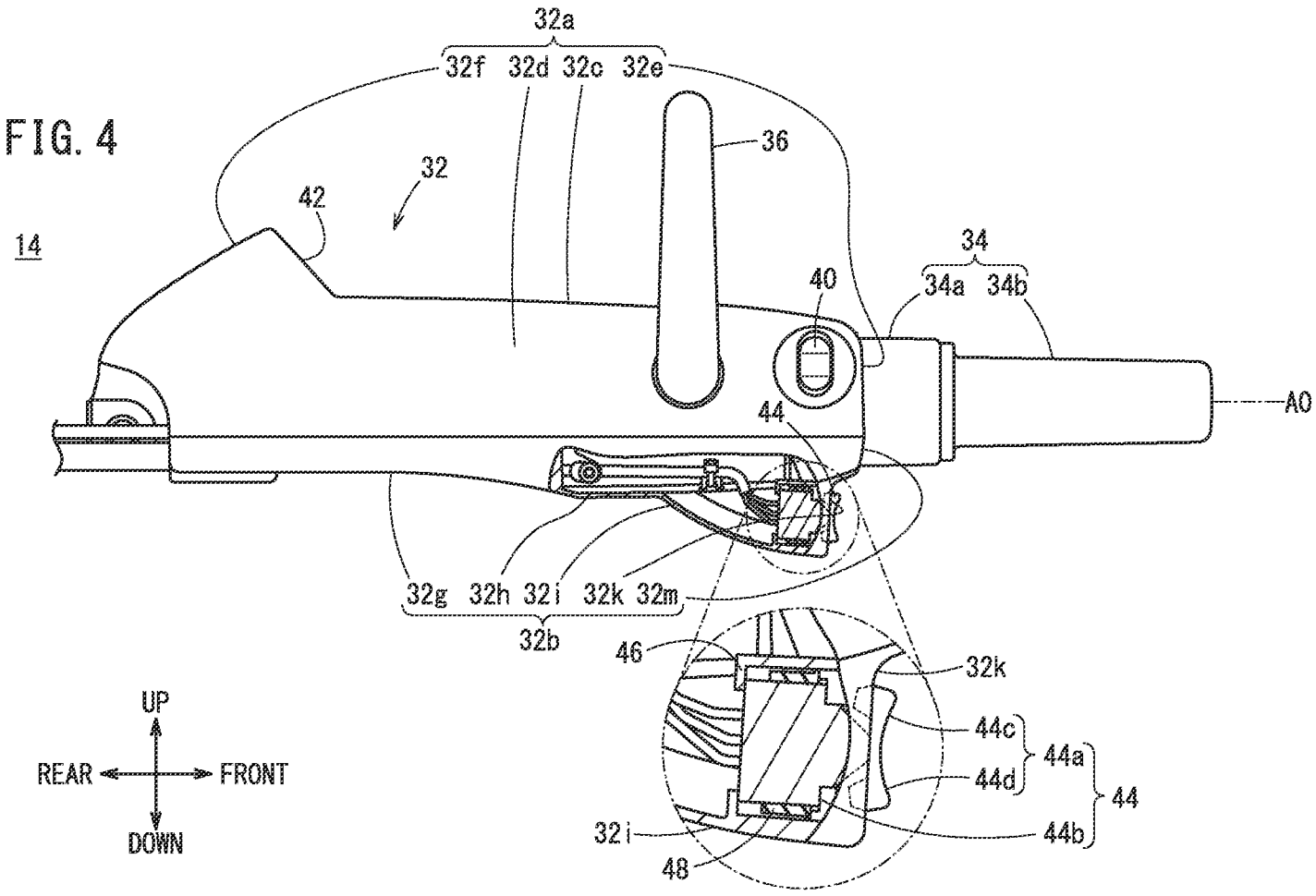
FIG. 4 is a side view showing the tiller handle.
Figure 5:
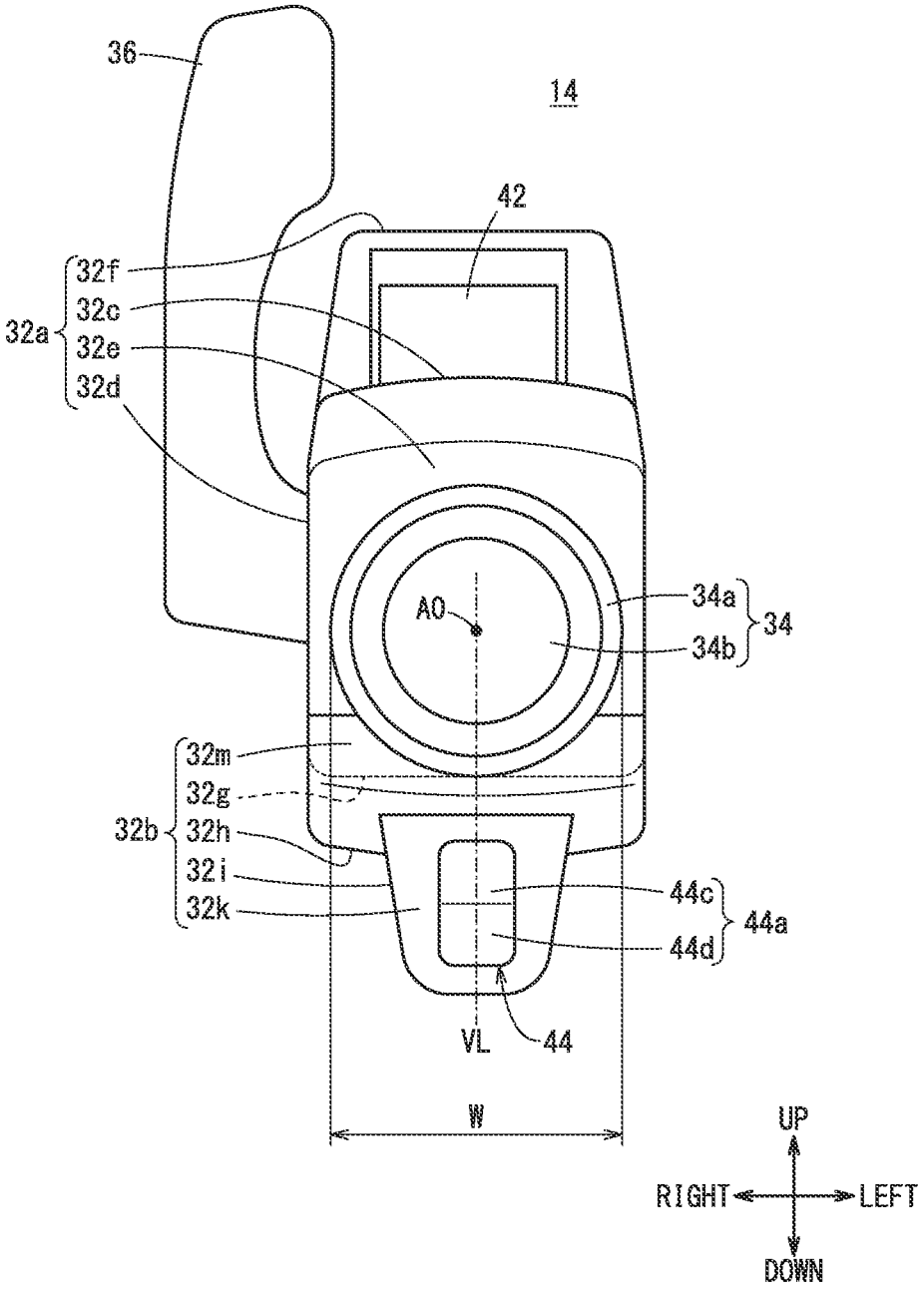
FIG. 5 is a front view showing the tiller handle.

FIG. 3 is a perspective view showing the tiller handle 14. FIG. 4 is a side view showing the tiller handle 14. FIG. 5 is a front view showing the tiller handle 14. Hereinafter, description will be given basically using FIG. 3, and other drawings will be referred to as necessary.

The tiller handle 14 includes a tiller handle body 32 and a throttle handle (grip handle) 34. The tiller handle body 32 extends forward (toward the hull H) from the side portion of the outboard motor body 12.

The tiller handle body 32 has an upper housing 32*a*, a lower housing 32*b*, a shift lever 36, a tilt switch 40, a display unit 42, and a trolling switch 44.

The upper housing 32*a* constitutes the upper portion of the tiller handle body 32 (housing of the tiller handle 14). The upper housing 32*a* is made of, for example, a metallic material. The lower housing 32*b* constitutes the lower portion of the tiller handle body 32. The lower housing 32*b* is made of, for example, a resin material. This allows the tiller handle body 32 to be both strong and cost effective. The upper portion relatively easy to receive an impact from the outside is constituted of a metallic material (for example, aluminum) relatively large in strength. The lower portion relatively hard to receive an impact from the outside is formed of a relatively low-cost resin material (for example, ABS resin). Accordingly, the strength of the entire tiller handle body 32 can be ensured, and at the same time, the cost can be relatively reduced. The upper housing 32*a* is made of a metallic material, but may be coated with an appropriate coating material or the like.

The upper housing 32*a* has an upper surface 32*c*, a side surface 32*d*, and a front end surface 32*e*, all of which are substantially flat. However, a part of the upper surface 32*c* has a convex portion 32*f*. The lower housing 32*b* has a bulging portion 32*h* and a protruding portion 32*i*. The bulging portion 32*h* bulges downward from the substantially flat lower surface 32*g*. The protruding portion 32*i* protrudes downward from the bulging portion 32*h*. The protruding portion 32*i* protrudes downward from a position that lies below the throttle handle 34. The (front end portion of the) protruding portion 32*i* has a front end surface 32*k* (the lower front end surface of the tiller handle body 32). The front end surface 32*k* of the protruding portion 32*i* is positioned lower than the front end surface 32*m* of the lower housing 32*b*. As shown in FIG. 4, the front end surface 32*k* of the protruding portion 32*i* is located slightly more rearward (i.e., closer to the outboard motor body 12) than the front end surface 32*e* of the upper housing 32*a* and the front end surface 32*m* of the lower housing 32*b*. As shown in FIG. 5, the width of the protruding portion 32*i* in the left-right direction is narrower than the width of the lower surface 32*g* in the left-right direction and the width of the bulging portion 32*h* in the left-right direction. In addition, the width of the protruding portion 32*i* in the left-right direction decreases downward. That is, the protruding portion 32*i* has a tapered shape.

The throttle handle 34 extends forward from the front end surface 32*e* of the tiller handle body 32 along the center line A0. The throttle handle 34 is used to steer the outboard motor body 12 (and adjust the vessel speed) via the tiller handle body 32.

The throttle handle 34 has a support portion 34*a* and a grip 34*b*. The support portion 34*a* extends from the front end surface 32*e* of the tiller handle body 32 in a direction along the center line A0. The support portion 34*a* is fixed to the tiller handle body 32. The support portion 34*a* rotatably supports the grip 34*b* about the center line A0. The grip 34*b* extends from the front end surface of the support portion 34*a* in a direction along the center line A0. The grip 34*b* is rotatably supported with respect to the support portion 34*a*. The vessel operator P grips the grip 34*b* with his/her hand to steer the outboard motor body 12. The vessel operator P can adjust the opening degree of a throttle valve (not shown) inside the outboard motor body 12 by turning the grip 34*b*. That is, the vessel operator P can adjust the rotation speed (vessel speed) of the propeller 16 by turning the grip 34*b*.

The shift lever 36 is attached to a side surface 32*d* of the upper housing 32*a*. The shift lever 36 is a lever for switching between forward movement and backward movement of the hull H. The shift lever 36 is connected to a gear clutch mechanism (not shown) of the engine 18 via a cable or the like. The rotational direction of the propeller 16 is switched in accordance with the forward/rearward inclination of the shift lever 36.

The tilt switch 40 is attached to a portion of the side surface 32*d* that lies near the front end surface 32*e* of the upper housing 32*a*. The tilt switch 40 instructs a tilt operation of the outboard motor body 12. The tilt switch 40 is electrically connected to a tilt cylinder (not shown) that tilts the outboard motor body 12.

The display unit 42 includes, for example, a light emitting diode, a liquid crystal display device, an electroluminescent (EL) display device, or a vacuum fluorescent display (VFD). The display unit 42 is attached to the convex portion 32*f* of the upper surface 32*c* of the upper housing 32*a*. The display unit 42 displays the state of the outboard motor 10. The state of the outboard motor 10 is represented by, for example, information for identifying a normal mode and a trolling mode as described later, information indicating whether the lubricant pressure is appropriate, and information indicating whether the coolant water temperature is appropriate.

The trolling switch 44 is attached to the front end surface 32*k* of the lower housing 32*b* of the tiller handle body 32. Therefore, the trolling switch 44 is disposed below and near the throttle handle 34. Thus, as will be described later, it is possible to ensure operability of steering and vessel speed adjustment.

The trolling switch 44 increases and decreases the rotational speed (trolling speed) of the propeller 16 in the trolling mode.

As shown in FIG. 4, the trolling switch 44 has an operation portion 44*a* and a switch main body 44*b*. The operation portion 44*a* is pressed rearward by a finger (for example, a thumb) of the vessel operator P. The front surface of the operation portion 44*a* is a finger contact surface with which a finger of the vessel operator P touches. The operation portion 44*a* has an upper part 44*c* and a lower part 44*d* arranged vertically. The switch main body 44*b* outputs a signal in accordance with the state of the operation portion 44*a* (an operation state of the operation portion 44*a* operated by the vessel operator P).

The upper part 44*c* and the lower part 44*d* of the trolling switch 44 can be configured by independent switches (an upper switch and a lower switch). However, the upper part 44*c* and the lower part 44*d* of the trolling switch 44 may be integrally formed using a seesaw switch, a toggle switch, or the like.

As shown in FIG. 4, the switch main body 44*b* is accommodated in the lower housing 32*b*. The lower housing 32*b* has a housing portion 46 for housing the switch main body 44*b*. The housing portion 46 is disposed in the protruding portion 32*i* of the lower housing 32*b*. The housing portion 46 has a substantially tubular shape (in particular, a substantially rectangular tubular shape) having front and rear openings. The switch main body 44*b* is housed in the internal space of the housing portion 46. A tubular seal member 48 is arranged between the switch main body 44*b* and the inner wall of the housing portion 46. The seal member 48 prevents seawater or the like from entering the lower housing 32*b* from an opening (the front-side opening of the housing portion 46) of the lower housing 32*b* in which the operation portion 44*a* is disposed.

Hereinafter, the mode will be described. The outboard motor 10 has a normal mode in which normal control is performed and a trolling mode in which the vessel speed is finely adjusted within a low-speed range. In the normal mode, the rotation speed of the propeller 16 is increased or decreased by the rotation of the grip 34*b*. In the trolling mode, the rotational speed of the propeller 16 is increased or decreased by the operation of the trolling switch 44. However, in order to maintain the trolling mode, the rotational position of the grip 34*b* needs to be within a predetermined low-speed range. That is, when the grip 34*b* is rotated beyond the low-speed range targeted by the trolling mode, the trolling mode is canceled, and the outboard motor 10 returns to the normal mode.

Mode switching will be described. Here, the outboard motor 10 shifts from the normal mode to the trolling mode by long-pressing one of the upper part 44*c* and the lower part 44*d* of the operation portion 44*a*. Thereafter, the outboard motor 10 returns from the trolling mode to the normal mode by long-pressing one of the upper part 44*c* and the lower part 44*d* of the operation portion 44*a* again. However, for example, the mode may be switched by simultaneously long-pressing both the upper part 44*c* and the lower part 44*d* of the trolling switch 44. In addition, a mode switching switch may be added to the tiller handle 14, and the mode may be switched by operating this switch. However, as described above, maintaining the trolling mode or switching from the normal mode to the trolling mode requires that the rotational position of the grip 34*b* should be within a predetermined low-speed range.

In the trolling mode, for example, when the upper part 44*c* of the operation portion 44*a* is pressed, the switch main body 44*b* outputs a signal instructing an increase in the rotation speed of the propeller 16. When the lower part 44*d* of the operation portion 44*a* is pressed, the switch main body 44*b* outputs a signal for instructing reduction of the rotational speed of the propeller 16. In this manner, the throttle valve of the engine 18 is adjusted based on the signal output from the trolling switch 44. As a result, in the trolling mode, the rotational speed (trolling speed) of the propeller 16 increases or decreases.

The operation portion 44*a* is attached to a lower front end surface (a front end surface 32*k* of the protruding portion 32*i*) of the tiller handle body 32. The protruding portion 32*i* protrudes downward from a position (bulging portion 32*h*) below the throttle handle 34. Therefore, an increase in size of the tiller handle body 32 due to the arrangement of the operation portion 44*a* on the lower front end surface of the tiller handle body 32 can be suppressed as much as possible.

The operation portion 44*a* is disposed below the throttle handle 34 (support portion 34*a*). The operation portion 44*a* is located between the throttle handle 34 and the outboard motor body 12 and near the throttle handle 34. Therefore, the vessel operator P can grip the throttle handle 34 (for example, the grip 34*b*) with his/her hand and simultaneously press the trolling switch 44 with his/her thumb. That is, it becomes easy to perform steering by hand (gripping of the throttle handle 34) and the operation of adjusting the trolling speed with the thumb simultaneously in parallel.

The operation portion 44*a* and a lower front end surface (front end surface 32*k*) of the tiller handle body 32 on which the operation portion 44*a* is disposed are disposed more rearward than the front end surface 32*e* of the tiller handle body 32. Thus, when the vessel operator P operates the throttle handle 34 in the normal mode, it is possible to prevent the thumb of the operator P from inadvertently touching the trolling switch 44.

FIG. 5 is a front view showing the tiller handle 14. FIG. 5 shows the trolling switch 44 when viewed from the front toward the rear along the center line A0 of the throttle handle 34. When the trolling switch 44 is viewed as shown in FIG. 5, the operation portion 44*a* of the trolling switch 44 is disposed below the throttle handle 34 and within the width W of the throttle handle 34 in the horizontal direction (left-right direction). The width W means the outer diameter of the throttle handle 34. Since the operation portion 44*a* is thus arranged, the vessel operator P can grip the throttle handle 34 with his/her hand and simultaneously cause the thumb of the hand to easily reach the operation portion 44*a*. When the trolling switch 44 is viewed as shown in FIG. 5, the operation portion 44*a* of the trolling switch 44 is located on a vertical line VL passing through the center line A0. Since the operation portion 44*a* is thus arranged, the vessel operator P can grip the throttle handle 34 with his/her hand and simultaneously cause the thumb of the hand to easily reach the operation portion 44*a*.

[Modifications]

The present invention is not limited to the embodiments described above, but can be configured in various ways without departing from the essence and gist of the present invention.

[Inventions Obtained from Embodiments]

Inventions from the above-mentioned embodiment will be described below.

[1] The outboard motor (10) includes a trolling mode. The outboard motor includes an outboard motor body (12) having a propeller (16) and a drive source (engine 18), a tiller handle body (32) extending forward from the outboard motor body, a grip handle (34) extending from a front end surface (32*e*) of the tiller handle body and configured to steer the outboard motor body via the tiller handle body, and a trolling switch (44) attached to the tiller handle body and configured to adjust a trolling speed. An operation portion (44*a*) of the trolling switch is attached to a lower front end surface (front end surface 32*k*) of the tiller handle body, the lower front end surface being located below the grip handle. Therefore, the vessel operator (P) can grip the grip handle with his/her hand and simultaneously operate the trolling switch with the thumb of the hand to adjust the trolling speed easily.

[2] The operation portion of the trolling switch includes an upper part (44*c*) configured to increase the trolling speed by being pressed and a lower part (44*d*) configured to decrease the trolling speed by being pressed. Thus, the vessel operator can increase or decrease the vessel speed intuitively and easily by pressing the upper part and the lower part.

[3] The lower front end surface of the tiller handle body and the operation portion of the trolling switch are disposed more rearward than the front end surface of the tiller handle body. Thus, when the vessel operator operates the grip handle in the normal mode, the operator's thumb can be prevented from touching the trolling switch.

[4] When the trolling switch is viewed from the front toward the rear along a center line (A0) of the grip handle, the operation portion of the trolling switch is disposed below the grip handle within a range of a horizontal width (W) of the grip handle. Thus, the vessel operator grips the throttle handle with his/her hand, and at the same time, the thumb of the hand easily reaches the operation portion.

[5] When the trolling switch is viewed from the front toward the rear along the center line of the grip handle, the operation portion of the trolling switch is disposed on a vertical line (VL) passing through the center line of the grip handle. This makes it easier for the operator to grip the throttle handle and, at the same time, cause the thumb of the hand to reach the operation portion.

[6] The tiller handle body includes a protruding portion (32*i*) protruding downward at a position lower than the grip handle, and a front end portion of the protruding portion includes the lower front end surface. Therefore, an increase in size of the tiller handle body due to the arrangement of the operation portion of the trolling switch on the lower front end surface of the tiller handle body can be suppressed as much as possible.

[7] The tiller handle body includes: an upper housing (32*a*) made of a metal material and including the front end surface; and a lower housing (32*b*) made of a resin material and including the lower front end surface, the lower housing being disposed below the upper housing. With this configuration, the upper portion of the tiller handle body is made of a metal material and the lower portion thereof is made of a resin material, thereby allowing the tiller handle body to be both strong and cost effective.

[8] The lower housing houses at least a portion of the trolling switch, and the outboard motor further includes a seal member (48) that seals a gap between the trolling switch and the lower housing. Thus, the seal member can protect the trolling switch from seawater or the like.

What is claimed is:

1. An outboard motor including a trolling mode, the outboard motor comprising:

an outboard motor body including a propeller and a drive source;

a tiller handle body extending forward from the outboard motor body;

a grip handle extending from a front end surface of the tiller handle body and configured to steer the outboard motor body via the tiller handle body; and a trolling switch attached to the tiller handle body and configured to adjust a trolling speed, wherein an operation portion of the trolling switch is attached to a lower front end surface of the tiller handle body, the lower front end surface being located below the grip handle, and wherein the operation portion of the trolling switch includes an upper part configured to increase the trolling speed by being pressed and a lower part configured to decrease the trolling speed by being pressed.

2. The outboard motor according to claim 1, wherein the lower front end surface of the tiller handle body and the operation portion of the trolling switch are disposed more rearward than the front end surface of the tiller handle body.

3. The outboard motor according to claim 1, wherein when the trolling switch is viewed from a front toward a rear along a center line of the grip handle, the operation portion of the trolling switch is disposed below the grip handle and within a range of a horizontal width of the grip handle.

4. The outboard motor according to claim 1, wherein when the trolling switch is viewed from a front toward a rear along a center line of the grip handle, the operation portion of the trolling switch is disposed on a vertical line passing through the center line of the grip handle.

5. The outboard motor according to claim 1, wherein the tiller handle body includes a protruding portion protruding downward at a position lower than the grip handle, and a front end portion of the protruding portion includes the lower front end surface.

6. The outboard motor according to claim 1, wherein the tiller handle body comprises:

an upper housing made of a metal material and including the front end surface; and a lower housing made of a resin material and including the lower front end surface, the lower housing being disposed below the upper housing.

7. The outboard motor according to claim 6, wherein the lower housing houses at least a portion of the trolling switch; and the outboard motor further includes a seal member configured to seal a gap between the trolling switch and the lower housing.

* * * * *